US006474117B2

(12) United States Patent
Okuno

(10) Patent No.: US 6,474,117 B2
(45) Date of Patent: Nov. 5, 2002

(54) ANTITHEFT DEVICE

(75) Inventor: Hirokazu Okuno, Izumi (JP)

(73) Assignee: Sensormatic Electronics, Boca Raton, FL (US)

( * ) Notice: Subject to any disclaimer, the term of this patent is extended or adjusted under 35 U.S.C. 154(b) by 0 days.

(21) Appl. No.: 09/927,370

(22) Filed: Aug. 13, 2001

(65) Prior Publication Data

US 2002/0024440 A1 Feb. 28, 2002

(30) Foreign Application Priority Data

Aug. 31, 2000 (JP) ..... 2000-262317

(51) Int. Cl.[7] ..... E05B 65/00

(52) U.S. Cl. ..... 70/57.1; 363/702; 340/572.1; 340/572.9

(58) Field of Search ..... 343/702; 340/571, 340/572.1, 572.3, 572.8, 572.9; 70/57.1

(56) References Cited

U.S. PATENT DOCUMENTS 3,914,829 A * 10/1975 Paskert ..... 24/526
3,942,829 A * 3/1976 Humble et al. ..... 70/57.1
4,012,813 A * 3/1977 Martens et al. ..... 27/704.2
4,221,025 A * 9/1980 Martens et al. ..... 24/704.1
4,311,992 A * 1/1982 Dechant ..... 24/563
5,421,177 A * 6/1995 Sieber et al. ..... 27/704.1
5,426,419 A * 6/1995 Nguyen et al. ..... 340/572.9
5,953,799 A * 9/1999 Seidel ..... 24/704.1
5,955,951 A * 9/1999 Wischerop et al. ..... 340/10.42
6,052,876 A * 4/2000 Hogan et al. ..... 24/704.1
6,191,692 B1 * 2/2001 Stolz et al. ..... 340/572

FOREIGN PATENT DOCUMENTS

JP 408314384 A * 11/1996 ..... G09F/3/12

* cited by examiner

*Primary Examiner*—Tan Ho
*Assistant Examiner*—Shih-Chao Chen
(74) *Attorney, Agent, or Firm*—Rader, Fishman & Grauer PLLC

(57) ABSTRACT

An antitheft device comprises a tag 10 and a member 2 for attaching the tag to a commodity. The attaching member 2 comprises a button 22 and a pin 21 projecting therefrom. The tag 10 includes a housing 1 having arranged therein a clamp member 3 for clamping the pin 21 of the attaching member 2, an on-off switch 8 to be depressed by the button 22 of the attaching member 2, and a buzzer 6 operable under the control of on-off signals from the switch 8. The clamp member 3 is rotatably supported and disengageable from pin 21 when the clamp member 3 is rotated in one direction. The on-off switch 8 comprises an actuator 82 projecting outward from the housing 1, and a cylindrical guide portion 83 provided around the base end of the actuator 82 and serving as a pivot for supporting the clamp member 3 thereon. The device is adapted to reliably prevent unlawful acts without becoming large-sized.

4 Claims, 11 Drawing Sheets

ANTITHEFT DEVICE

FIELD OF THE INVENTION

The present invention relates to antitheft devices for use as attached to commodities for preventing the commodity from being stolen, and more particularly to antitheft devices comprising a tag performing the function of preventing theft occurring upon escaping from a control area, and a member for attaching the tag to the commodity.

BACKGROUND OF THE INVENTION

FIGS. 9 to 15 show an antitheft device already proposed (Japanese Patent No. 2849048). The device comprises a tag 15 having a flat housing 16 composed of a lower half segment 17 and an upper half segment 18, and a member 2 for attaching the tag 15 to a garment or like commodity 9 as shown in FIG. 9.

With reference to FIG. 10, the housing 16 of the tag 15 has enclosed therein a sensor 40 which performs a specified theft preventing function when the tag 15 as affixed to the commodity is to be brought out of the store past a gate to actuate a theft alarm device installed in the gate.

With reference to FIG. 15, the attaching member 2 comprises a button 22 in the form of a disk, and a pin 21 projecting from the rear side of the button 22. A pinhole 18*a* is formed in the upper half segment 18 constituting the housing 16 for inserting therethrough the pin 21 of the attaching member 2 as shown in FIG. 11. As seen in FIG. 12, the lower half segment 17 constituting the housing 16 is provided with a cylindrical portion 17*a* for the outer end of the pin 21 of the attaching member 2 to fit in (see FIG. 10).

With reference to FIG. 14, a spring clamp member 3 made of sheet metal is disposed inside the housing 16 of the tag 15. As shown in FIG. 13, the spring clamp member 3 includes a main body 31 in the form of a flat plate and provided with a pair of clamp pieces 32, 32 for clamping the pin 21 of the attaching member 2 therebetween. The clamp pieces 32, 32 have outer end faces providing a clamp portion 34. The main body 31 has a circular hole 35 formed therein and a spring piece 36 projecting therefrom.

As shown in FIG. 12, the housing lower half segment 17 has a stepped cylindrical portion 17*b* positioned away from the cylindrical portion 17*a*. The spring clamp member 3 is rotatably supported on the housing lower half segment 17 by the stepped cylindrical portion 17*b* fitting in the circular hole 35 as seen in FIG. 14. The clamp member 3 has its spring piece 36 retained at the outer end thereof on the lower half segment 17 by engagement therewith. The spring piece 36 is elastically deformed by counterclockwise rotation of the main body 31, giving a clockwise repulsive force to the main body 31.

Referring to FIG. 9, a small opening 13 is formed in the housing 16 of the tag 15. The opening 13 communicates with the space wherein the clamp member 3 is installed through an inlet passage 14 formed in the housing lower half segment 17 as shown in FIG. 14. With the tag 15 attached to the commodity 9 by the attaching member 2 as seen in FIG. 9, the pin 21 of the attaching member 2 is clamped by the spring clamp member 3 (see FIG. 10), whereby the attaching member 2 is prevented from being pulled out.

If the tag 15 as attached to the commodity is to be brought out of the store past the gate, the sensor 40 incorporated in the tag 15 receives a radio signal (e.g., lines of magnetic force) from the theft alarm device installed in the gate, and transmits a radio signal (e.g., altered magnetic field) to a theft preventing system in response to the received signal. Consequently, an alarm incorporated in the system is actuated, notifying salesclerks of the theft. When the pin 21 is to be released from the clamp member 3 for the salesclerk to remove the tag 15 from the commodity, an unclamping probe 7 shown in FIG. 9 is used.

With reference to FIG. 15, the forward end of the probe 7 is inserted into the clamp member accommodating space from the housing opening 13 through the inlet passage 14 to push the main body 31 of the clamp member 3 with the probe end against the elasticity of the spring piece 36. This rotates the clamp member 3 counterclockwise, thereby disengaging the clamp portion 34 of the clamp member 3 from the pin 21 of the attaching member 2 to unclamp the pin 21. As a result, the attaching member 2 can be removed.

However, since the pin 21 of the attaching member 2 clamped by the clamp member 3 as shown in FIG. 10 can be cut at its base portion with a simple tool, the antitheft device has the problem of suffering an incident in that the tag 15 as attached to the commodity 9 is separated therefrom by cutting the pin 21 of the attaching member 2 to bring the commodity 9 only out of the store unlawfully.

Accordingly, it appears useful to take a countermeasure by providing a sensor on the tag 15 for detecting the separation of the tag 15 from the commodity by the cutting of the pin 21. Although it is required that the tag 15 for use as attached to the commodity be compacted to the greatest possible extent, there arises the problem that the provision of the sensor makes the tag 15 larger in size.

SUMMARY OF THE INVENTION

An object of the present invention is to provide an antitheft device which is capable of reliably preventing the foregoing wrongful act and which is nevertheless made compact.

The present invention provides an antitheft device which comprises a tag 10 for performing a theft preventing function upon an escape from a specified control area, and an attaching member 2 for attaching the tag 10 to a commodity 9. The attaching member 2 comprises a button 22, and a pin 21 projecting from the button 22 and movable into a housing 1 of the tag 10 through a pinhole 12*a* formed in the housing 1.

Arranged inside the housing 1 of the tag 10 are a clamp member 3 for clamping the pin 21 of the attaching member 2 as moved in through the pinhole 12*a*, an on-off switch 8 to be depressed by the button 22 of the attaching member 2, and a theft alarm operable under the control of on-off signals from the on-off switch 8.

The clamp member 3 has a clamp portion 34 for the pin 21 of the attaching member 2 to be inserted therethrough for clamping the pin 21 unremovably. The clamp member 3 is rotatably supported by a pivot provided inside the housing 1, permits the clamp portion 34 to be disengaged from the pin 21 when rotated about the pivot in one direction and is given an elastic repulsive force against the rotation.

The housing 1 is provided with an inlet passage 14 for an unclamping probe 7 for pushing the clamp member 3 into rotation toward the above-mentioned one direction. The on-off switch 8 comprises an actuator 82 having an outer end projecting outward from the housing 1 through a hole 12*b* formed in the housing 1, and a cylindrical guide portion 83 formed around a base end portion of the actuator 82 and providing the pivot for the clamp member 3.

The stepped cylindrical portion 17*b* provided in the conventional antitheft device for rotatably supporting the clamp member 3 thereon is omitted from the antitheft device of the present invention, while the on-off switch 8 is disposed at the corresponding position for the cylindrical guide portion 83 of the switch 8 to rotatably support the clamp member 3. When the tag 10 as attached to the commodity 9 is to be brought out of the specified control area, the salesclerk is notified of the situation by the antitheft function of the tag 10 as is the case with the conventional device.

The unclamping probe 7 is used for the salesclerk to remove the tag 10 from the commodity 9 as in the prior art. Stated more specifically, the forward end of the probe 7 is inserted into the space wherein the clamp member 3 is provided by way of the inlet passage 14 of the housing 1 to push the clamp member 3 with the forward end against the elastic repulsive force, where by the clamp member 3 is rotated in the above-mentioned one direction to thereby disengage the clamp portion 34 from the pin 21 of the attaching member 2 and unclamp the pin 21. Consequently, the attaching member 2 becomes removable.

If the pin 21 of the attaching member 2 is cut with the tag 10 affixed to the commodity 9, the removal of the button 22 of the attaching member 2 from the tag 10 frees the actuator 82 of the on-off switch 8 from the depression by the button 22, projecting the actuator 82 from the depressed position to a released position to turn off the switch which is closed. As a result, an on signal from the switch 8 is changed for an off signal, which is fed to the theft alarm, notifying salesclerks of the occurrence of theft. The signal is so processed as to hold the theft alarm out of operation when the attaching member 2 is removed by the salesclerk using the probe 7.

The cylindrical guide portion 83 of the on-off switch 8 is utilized in the antitheft device of the invention in place of the stepped cylindrical portion 17*b* provided in the conventional antitheft device for rotatably supporting the clamp member 3. The additional provision of the on-off switch 8 is therefore unlikely to make the housing 1 greater in size. Accordingly, the present device remaining as large as the conventional antitheft device is adapted to reliably prevent the commodity 9 from being stolen by cutting the pin 21 of the attaching member 2.

DETAILED DESCRIPTION OF EMBODIMENT

Figure 9:
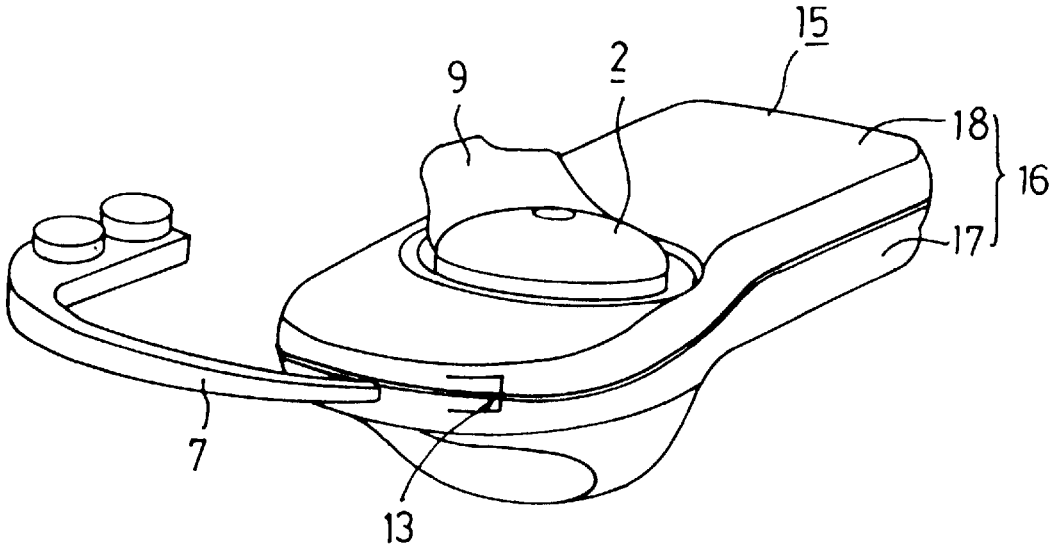
FIG.9 PRIOR ART
FIG. 9 is a perspective view showing the appearance of a conventional antitheft device.
Figure 10:
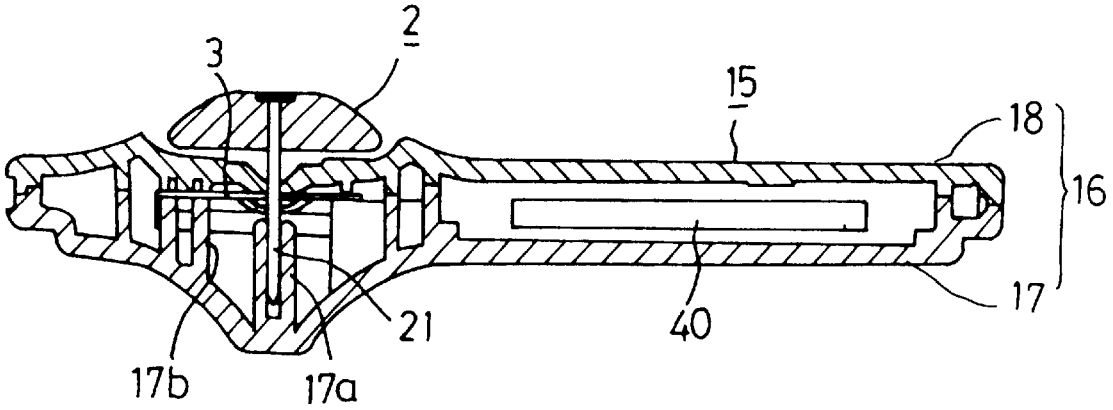
FIG.10 PRIOR ART
FIG. 10 is a sectional view of the device.
Figure 11:
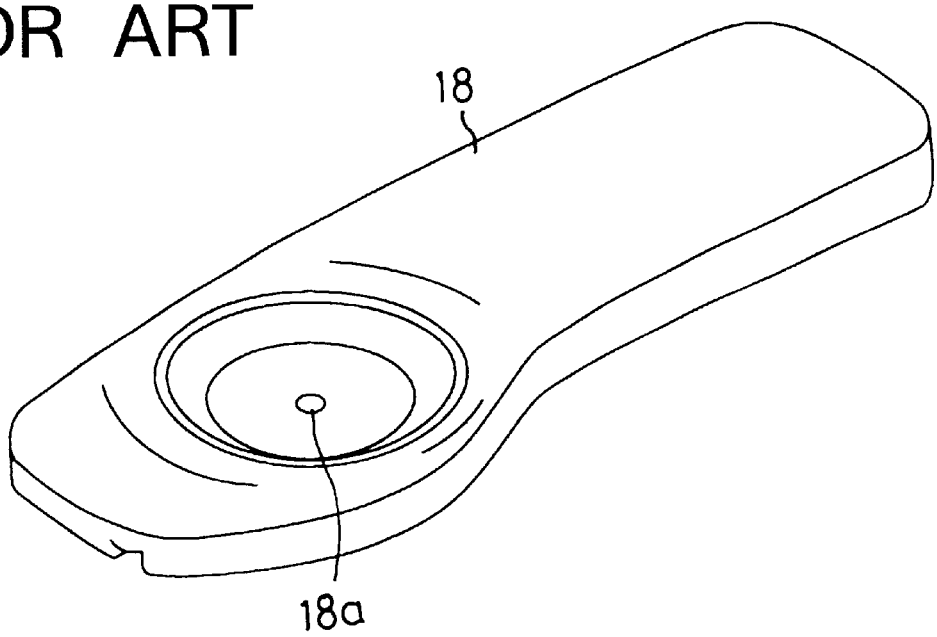
FIG.11 PRIOR ART
FIG. 11 is a perspective view of a housing upper half segment of the device.
Figure 12:
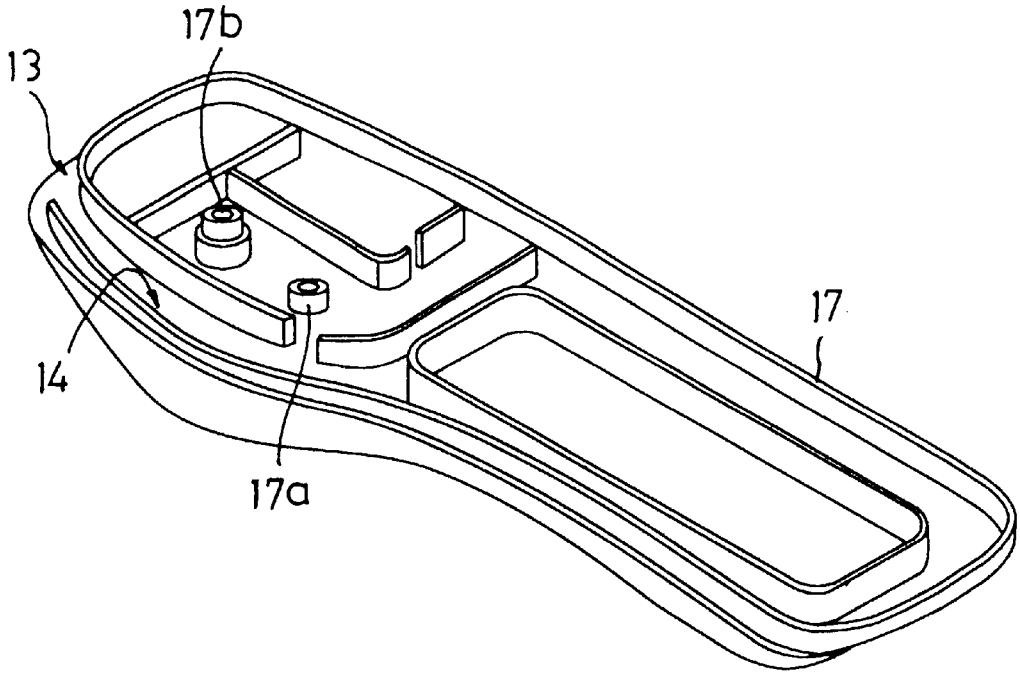
FIG.12 PRIOR ART
FIG. 12 is a perspective view of a housing lower half segment of the device.
Figure 13:
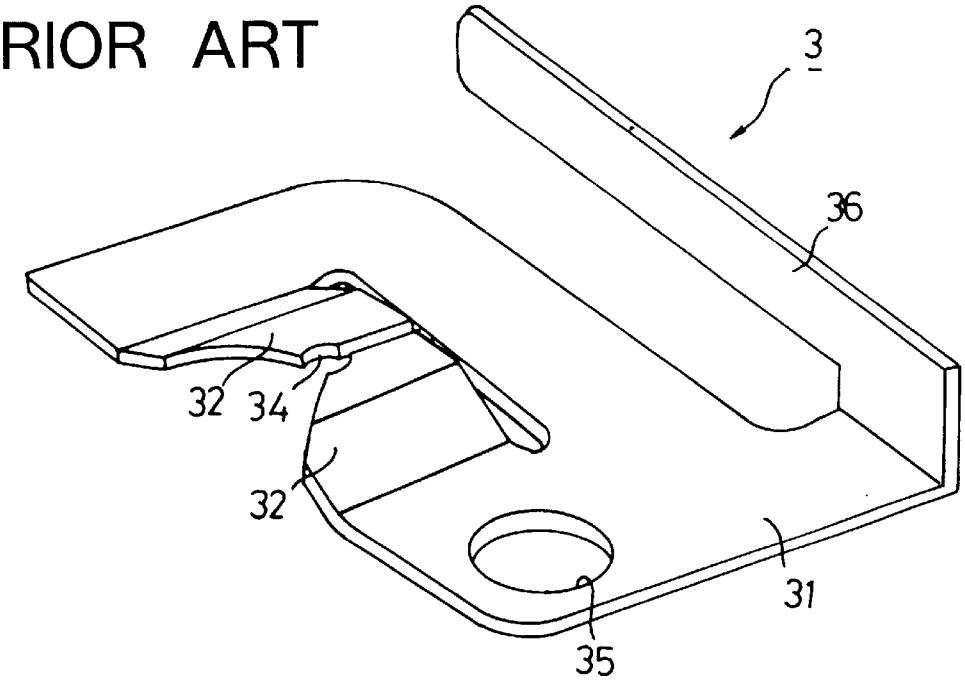
FIG.13 PRIOR ART
FIG. 13 is an enlarged perspective view of a spring clamp member.
Figure 14:
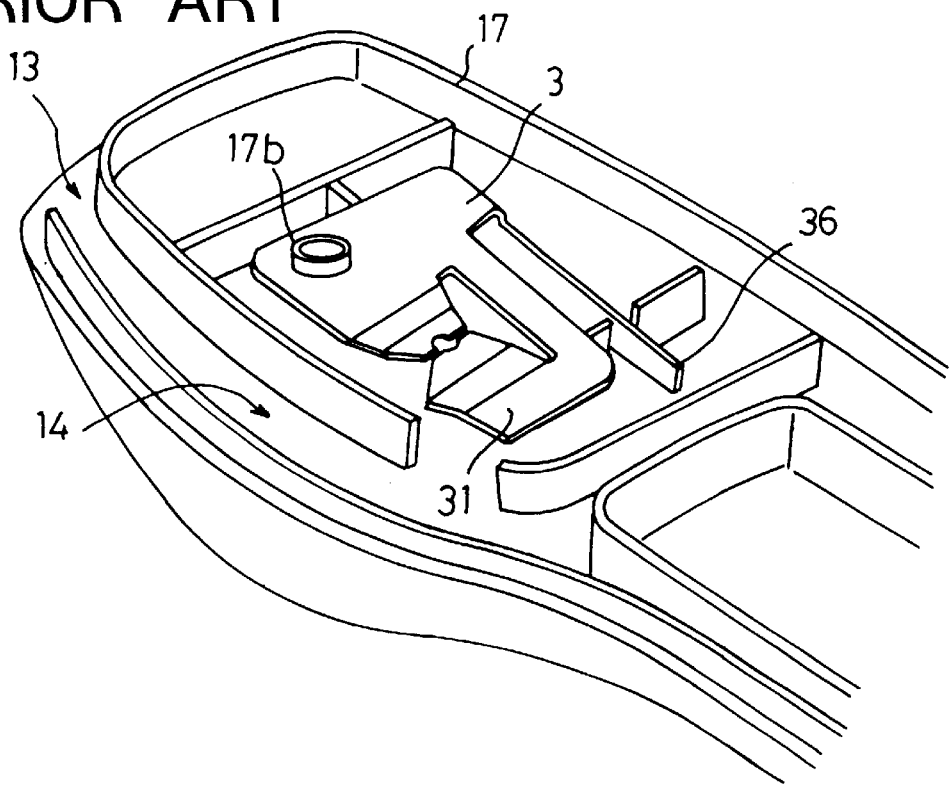
FIG.14 PRIOR ART
FIG. 14 is an enlarged perspective view showing the spring clamp member as mounted on the housing lower half segment of the device.
Figure 15:
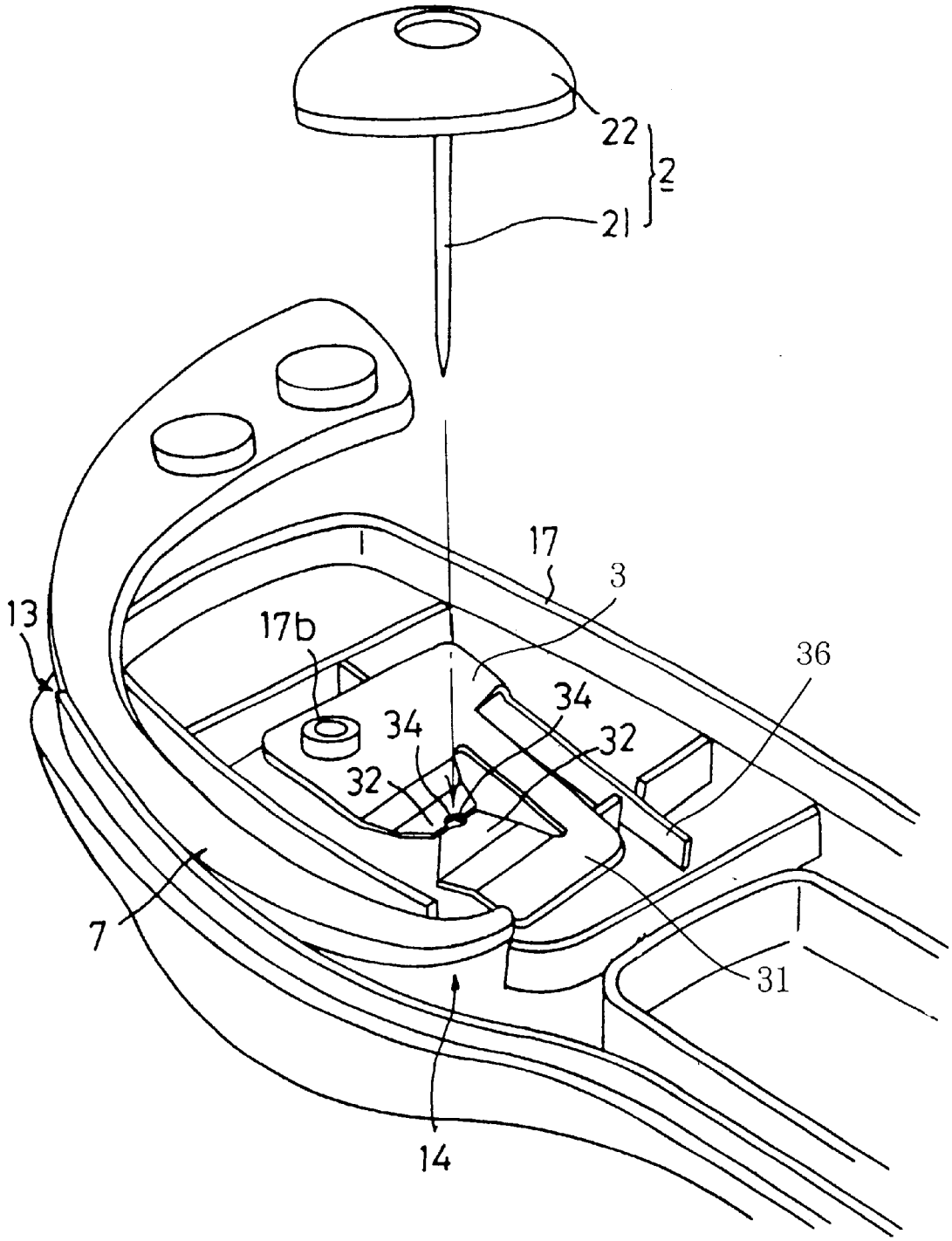
FIG.15 PRIOR ART
FIG. 15 is an enlarged perspective view of a probe as inserted into the housing of the device.

An embodiment of the present invention will be described below in detail with reference to the drawings. The antitheft device of the present invention is an improvement over the conventional antitheft device shown in FIGS. 9 to 15 (Japanese Patent No. 2849048) and is not different from the conventional device in the appearance shown in FIG. 9 and in the size of the device. Throughout the drawings, like parts are designated by like reference numerals and will not be described repeatedly when so desired.

Figure 1:
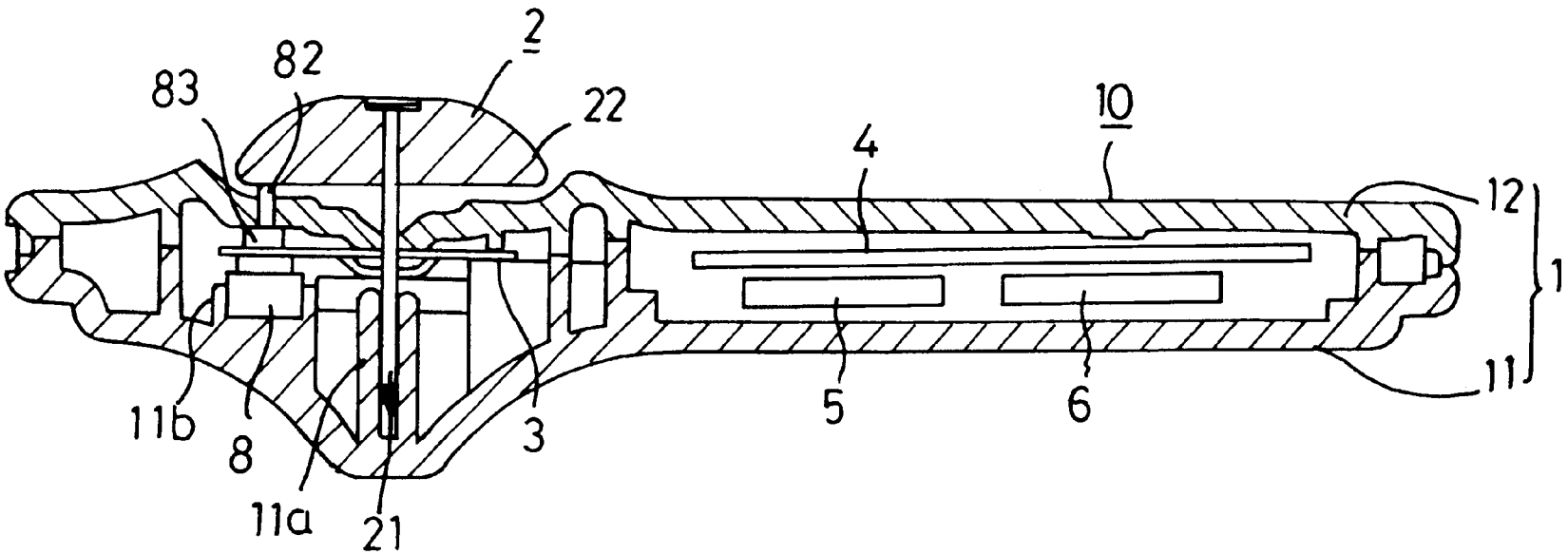
FIG. 1 is a view in section of an antitheft device embodying the invention, with an attaching member affixed to a tag.
Figure 2:
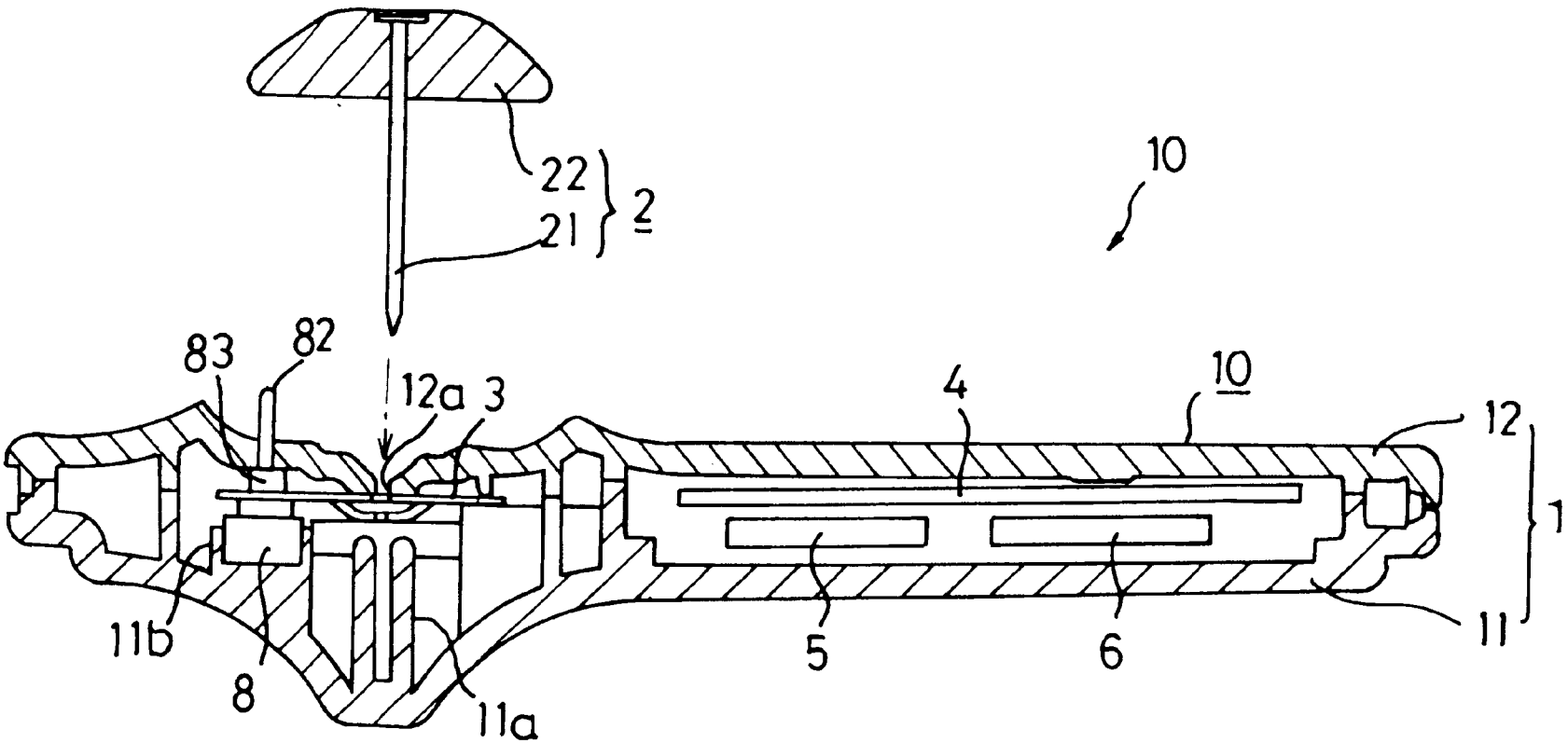
FIG. 2 is a view in section of the antitheft device, with the attaching member removed from the tag.

With reference to FIG. 1, a tag 10 has a housing 1, which comprises a lower half segment 11 and an upper half segment 12. Enclosed in the housing 1 are a circuit board 4 to perform a specified theft preventing function, a buzzer 6 to be actuated in the event of the unlawful act of cutting a pin 21 of an attaching member 2, and a cell 5 serving as a power source. Also disposed inside the housing 1 is an on-off switch 8 for detecting the unlawful act, if any, of cutting the pin 21 of the attaching member 2.

Figure 5:
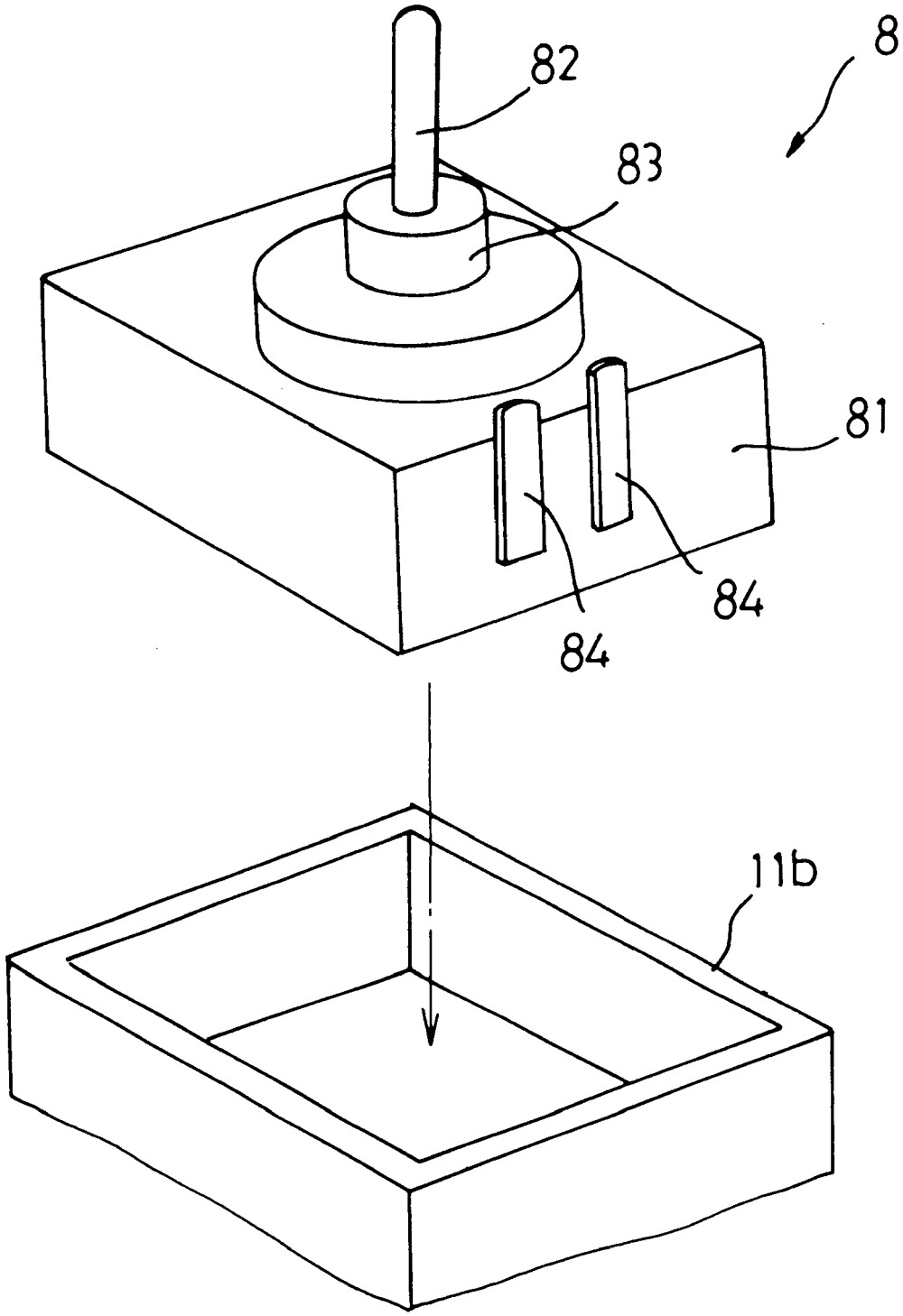
FIG. 5 is an enlarged perspective view of an on-off switch included in the device.

With reference to FIG. 5, the on-off switch 8 comprises a rectangular parallelepipedal body 81, a cylindrical guide portion 83 provided on the top of the body 81, and an actuator 82 to be guided for an upward or downward sliding movement by the guide portion 83. A pair of terminals 84, 84 are provided on a side wall of the body 81 for delivering the on or off signal to be produced upon a change-over between a depressed position (on position) and a released position (off position) of the actuator 82.

Figure 7:
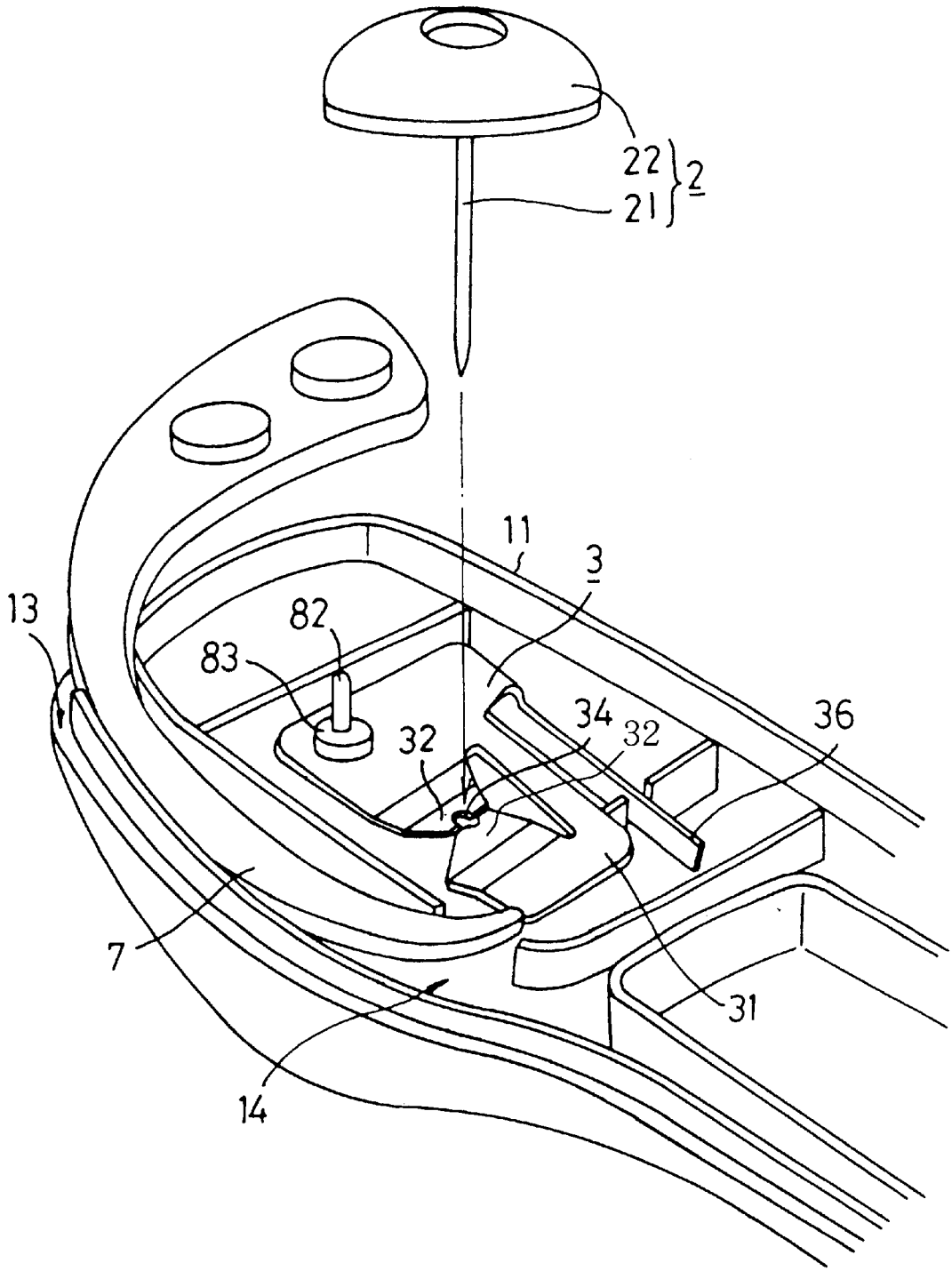
FIG. 7 is an enlarged perspective view of a probe as inserted into the housing of the device.
Figure 8:
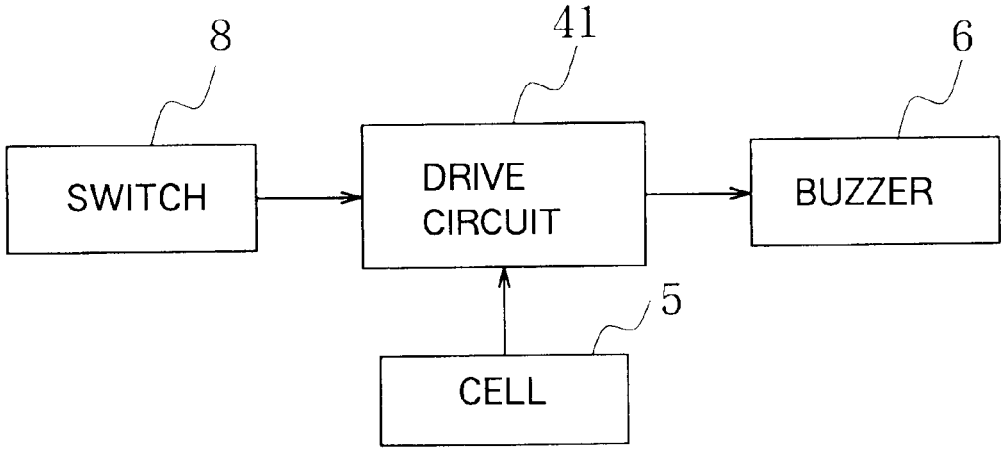
FIG. 8 is a block diagram showing the circuit construction of the antitheft device of the invention.

As shown in FIG. 8, the on or off signal output from the on-off switch 8 is fed to a drive circuit 41 on the circuit board 4. When the switch 8 in the on state is turned off, the drive circuit 41 drives the buzzer 6, notifying salesclerks of an unlawful act. The cell 5 supplies power to the drive circuit 41. As seen in FIG. 7, the attaching member 2 comprises a button 22 in the form of a disk, and the pin 21 projecting from the rear side of the button 22.

Figure 3:
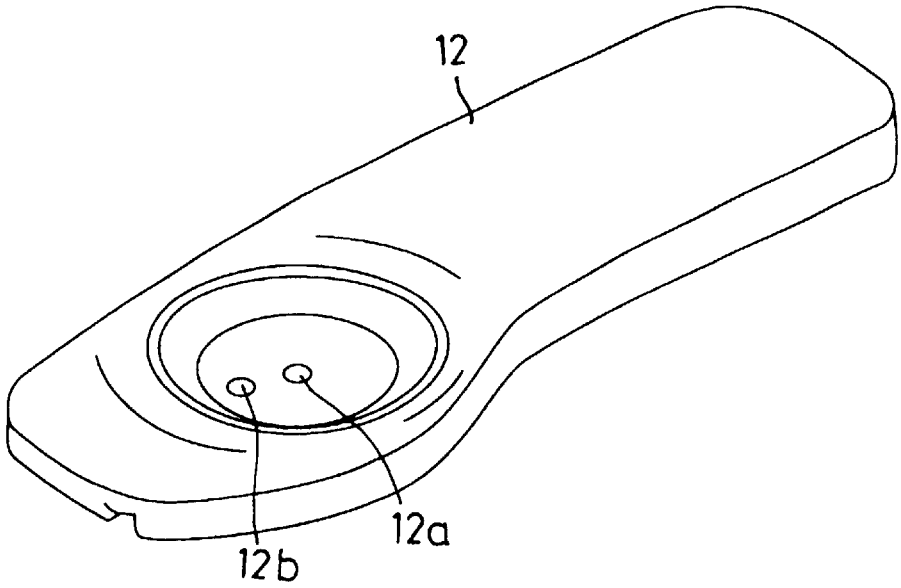
FIG. 3 is a perspective view of a housing upper half segment of the device.
Figure 4:
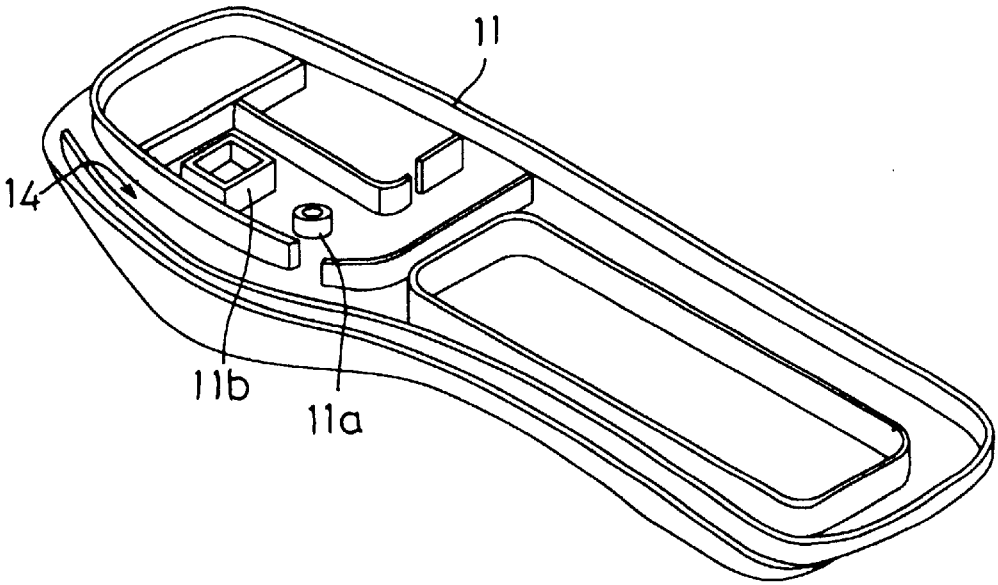
FIG. 4 is a perspective view of a housing lower half segment of the device.

With reference to FIG. 3, the upper half segment 12 constituting the housing 1 is provided, in the region thereof where the attaching member 2 is to be installed, with a pinhole 12*a* for inserting the pin 21 of the attaching member 2 therethrough and a hole 12*b* for inserting the actuator 82 of the on-off switch 8 therethrough. As shown in FIG. 4, the lower half segment 11 constituting the housing 1 is provided with a cylindrical portion 11*a* for the outer end of the pin 21 of the attaching member 2 to fit in, and a frame 11*b* for holding the body 81 of the on-off switch 8 therein (see FIG. 5).

Figure 6:
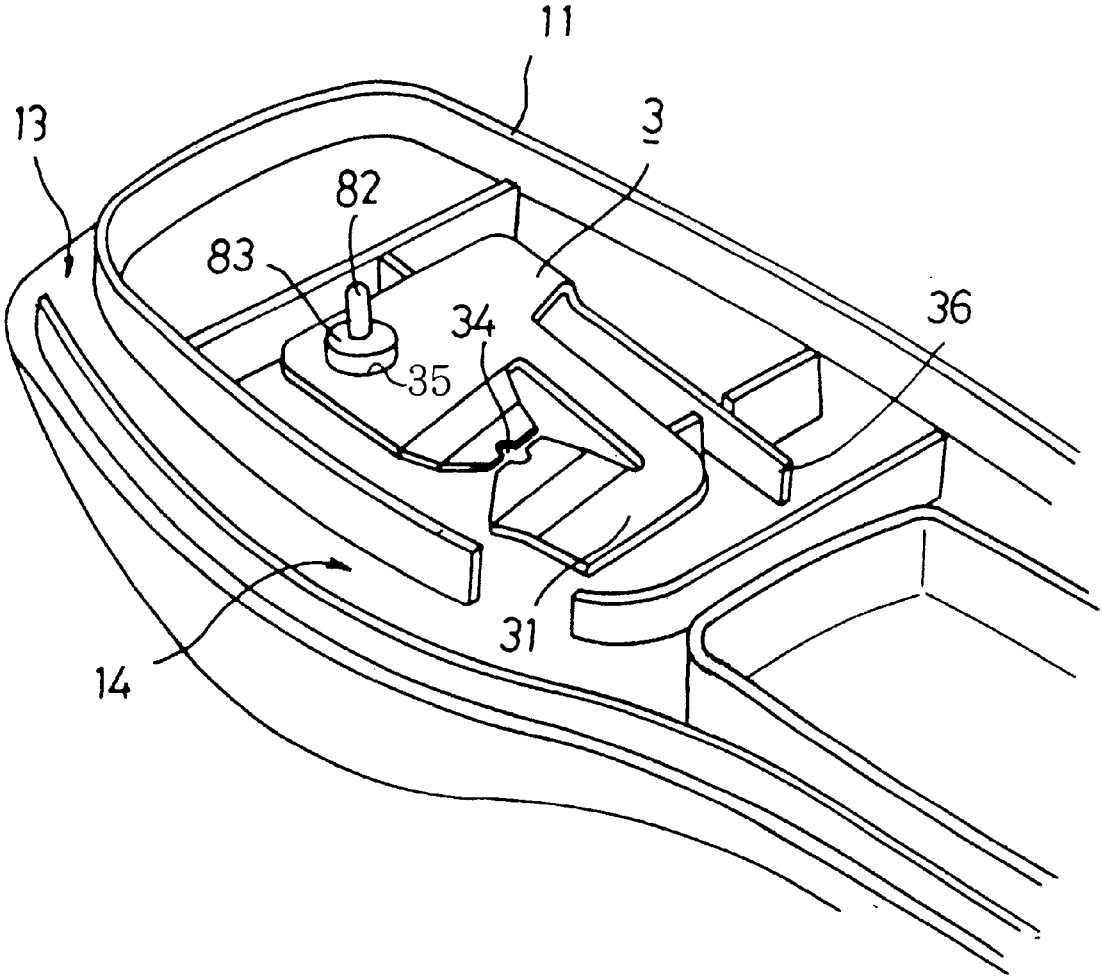
FIG. 6 is an enlarged perspective view showing a spring clamp member as mounted on the housing lower half segment of the device.

With reference to FIG. 6, a spring clamp member 3 having the same construction as the conventional one is disposed inside the housing 1 of the tag 10. The clamp member 3 is rotatably supported on the housing lower half segment 11 by the cylindrical guide portion 83 of the switch 8 fitted in a circular hole 35 formed in the main body 31 of the clamp member 3 as seen in FIG. 6. The clamp member 3 has a spring piece 36 which is retained at its outer end on the lower half segment 11 by engagement therewith. The spring piece 36 is elastically deformed by counterclockwise rotation of the main body 31 to exert a clockwise repulsive force.

With the tag 10 attached to a commodity by the clamp member 2, the pin 21 of the attaching member 2 is clamped by the spring clamp member 3 as seen FIG. 1, whereby the attaching member 2 is prevented from being pulled out.

If the tag 10 as attached to the commodity is to be brought out of the store past a gate, the tag 10 receives a radio signal (e.g., lines of magnetic force) from a theft alarm device installed in the gate, and transmits a radio signal (e.g., altered magnetic field) to a theft preventing system in response to the received signal. Consequently, an alarm incorporated in the system is actuated, notifying salesclerks of the occurrence of theft.

When the pin 21 is to be released from the clamp member 3 for the salesclerk to remove the tag 10 from the commodity, an unclamping probe 7 shown in FIG. 7 is used. The forward end of the probe 7 is inserted into the clamp member accommodating space from a housing opening 13 through an inlet passage 14 to push the main body 31 of the clamp member 3 with the probe end against the elasticity of the spring piece 36 as shown in the drawing. This rotates the clamp member 3 counterclockwise, thereby disengaging the clamp portion 34 of the clamp member 3 from the pin 21 of the attaching member 2 to unclamp the pin 21. As a result, the attaching member 2 can be removed.

If the pin 21 of the attaching member 2 is cut with the tag 10 affixed to a commodity, the removal of the button 22 of the attaching member 2 from the tag 10 frees the actuator 82 of the on-off switch 8 from the depression by the button 22, projecting the actuator 82 from the depressed position to a released position to turn off the switch 8 which is closed. As a result, an on signal from the switch 8 is changed over to an off signal, which is fed to the drive circuit 41 to drive the buzzer 6, notifying salesclerks of the occurrence of theft. The signal is so processed as to hold the drive circuit out of operation when the attaching member 2 is removed by the salesclerk using the probe 7.

A described above, the cylindrical guide portion 83 of the on-off switch 8 is utilized in the antitheft device of the invention in place of the stepped cylindrical portion 17*b* provided in the conventional antitheft device for rotatably supporting the clamp member 3. The additional provision of the on-off switch 8 is therefore unlikely to make the housing 1 greater in size. Accordingly, the present device remaining as large as the conventional antitheft device is adapted to reliably prevent the commodity from being stolen by cutting the pin 21 of the attaching member 2.

The device of the present invention is not limited to the foregoing embodiment in construction but can be modified variously without departing from the spirit of the invention as set forth in the appended claims. For example, the theft preventing system installed in the gate is adapted to produce an alarm when the tag 10 as attached to a commodity 9 is moved past the gate according to the foregoing embodiment, whereas the buzzer 6 incorporated in the tag 10 can be actuated in response to a radio signal from the theft preventing system installed in the gate.

What is claimed is:

1. An antitheft device comprising a tag (10) for performing a theft preventing function upon an escape from a specified control area, and an attaching member (2) for attaching the tag (10) to a commodity (9), the attaching member (2) comprising a button (22), and a pin (21) projecting from the button (22) and movable into a housing (1) of the tag (10) through a pinhole (12*a*) formed in the housing (1), the tag housing (1) having arranged therein a clamp member (3) for clamping the pin (21) of the attaching member (2) as moved in through the pinhole (12*a*), an on-off switch (8) to be depressed by the button (22) of the attaching member (2), and a theft alarm operable under the control of on-off signals from the on-off switch (8), the clamp member (3) having a clamp portion (34) for the pin (21) of the attaching member (2) to be inserted therethrough for clamping the pin (21) unremovably, the clamp member (3) being rotatably supported by a pivot provided inside the housing (1), permitting the clamp portion (34) to be disengaged from the pin (21) when rotated in one direction and being given an elastic repulsive force against the rotation, the housing (1) being provided with an inlet passage (14) for an unclamping probe (7) for pushing the clamp member (3) into rotation toward said one direction, the on-off switch (8) comprising an actuator (82) having an outer end projecting outward from the housing (1) through a hole (12*b*) formed in the hosuing (1), and a cylindrical guide portion (83) formed around a base end portion of the actuator (82) and providing the pivot for the clamp member (3).

2. An antitheft device according to claim 1 wherein the clamp member (3) has a circular hole (35) for the cylindrical guide porion (83) of the on-off switch (8) to fit in.

3. An antitheft device according to claim 1 wherein the clamp member (3) is made of a sheet metal and has a spring piece (36) projecting therefrom and retained in the housing by engagement therewith to exhibit the elastic repulsive force.

4. An antitheft device according to claim 1 wherein the theft alarm is provided by a buzzer (6) enclosed in the housing (1).

* * * * *